US007926219B2

(12) United States Patent
Reimer

(10) Patent No.: US 7,926,219 B2
(45) Date of Patent: Apr. 19, 2011

(54) DIGITAL SCOPE WITH HORIZONTALLY COMPRESSED SIDEFIELDS

(76) Inventor: Paul Kevin Reimer, Tallahassee, FL (US)

( * ) Notice: Subject to any disclaimer, the term of this patent is extended or adjusted under 35 U.S.C. 154(b) by 1140 days.

(21) Appl. No.: 11/650,134

(22) Filed: Jan. 5, 2007

(65) Prior Publication Data

US 2008/0163749 A1 Jul. 10, 2008

(51) Int. Cl.
*F41G 1/38* (2006.01)
*F41G 11/00* (2006.01)
*F41A 9/62* (2006.01)

(52) U.S. Cl. ..... 42/122; 42/1.02; 89/41.05

(58) Field of Classification Search ..... 42/1.02, 42/1.03, 119, 122; 89/41.05
See application file for complete search history.

(56) References Cited

U.S. PATENT DOCUMENTS 3,504,122 A * 3/1970 Ratliff, Jr ..... 348/47
3,505,465 A * 4/1970 Rees ..... 348/36
4,672,435 A * 6/1987 Gluck ..... 348/44
4,884,137 A * 11/1989 Hanson et al. ..... 348/158
4,936,190 A 6/1990 Pilcher, II
5,026,158 A 6/1991 Golubic
5,686,690 A * 11/1997 Lougheed et al. ..... 89/41.17
5,711,104 A 1/1998 Schmitz
5,834,676 A * 11/1998 Elliott ..... 89/41.05
5,887,375 A * 3/1999 Watson ..... 42/106
6,070,355 A 6/2000 Day
6,237,462 B1 * 5/2001 Hawkes et al. ..... 89/41.05
6,539,661 B2 * 4/2003 Hope ..... 42/119
6,679,158 B1 * 1/2004 Hawkes et al. ..... 89/41.05
6,792,206 B2 9/2004 Gordon
2002/0184810 A1 12/2002 Day

* cited by examiner

*Primary Examiner* — Bret Hayes
(74) *Attorney, Agent, or Firm* — J. Wiley Horton

(57) ABSTRACT

An improved digital scope for locating and targeting objects. The scope includes an image detection device that is configured to collect image data of a sighted region. The scope further includes a display screen that is electronically connected to the image detection device and is configured to display image data of the sighted region as a continuous video feed. The left sidefield portion of the sighted region is displayed horizontally compressed in the left portion of the display screen, the right sidefield portion of the sighted region is displayed horizontally compressed in the right portion of the display screen, and the center portion of the sighted region is displayed in the center portion of the display screen without horizontal compression.

16 Claims, 7 Drawing Sheets

DIGITAL SCOPE WITH HORIZONTALLY COMPRESSED SIDEFIELDS

BACKGROUND OF THE INVENTION

1. Field of the Invention

This invention relates to the field guns. More specifically the present invention comprises a digital scope with horizontally compressed sidefields for a pistol or other gun.

2. Description of the Related Art

Various optical and digital scopes have been provided for pistols and other guns. Although scopes are commonly employed on rifles, scopes have yet to be widely used on pistols, particularly on pistols designed for use in close-combat, tactical situations. Pistols are a weapon of choice in close-combat situations because of their maneuverability and ease of use. Unlike a rifle, a pistol may be carried in an unobtrusive holster and quickly drawn to a shooting position when needed. Whether holstered or held in a shooter's hand, a pistol does not significantly limit the shooter's movement. In addition, the open-site nature of the weapon allows a shooter to quickly point the pistol at a target without the loss of orientation experienced by many people when looking through a conventional scope.

Although many of the proposed scopes for pistols improve target visibility, the use of prior art scopes on pistols has several drawbacks. As mentioned previously, some suffer a loss of orientation when looking through a scope. Also, there has traditionally been a trade-off between the degree of magnification provided by a scope and the field of view provided to the user. In many cases, the scope itself obstructs the user's view of the field, particularly the area of the field immediately adjacent to the magnified portion of the field. In addition, conventional digital scopes must be "activated" or "turned on" before the scope can be used. This often requires the user to complete the additional step of pressing an "on" button before pointing the pistol at a target. Because of the close-combat nature of the weapon, requiring additional preparation steps is a significant disadvantage. Thus, there remains a need for an improved scope which avoids the shortcomings of the prior art.

BRIEF SUMMARY OF THE INVENTION

The present invention comprises an improved digital scope for locating and targeting objects. The scope includes an image detection means that is configured to collect image data of a sighted region. The scope further includes a display screen that is electronically connected to the image detection means and is configured to display image data of the sighted region as a continuous video feed. The left sidefield portion of the sighted region is displayed horizontally compressed in the left portion of the display screen. The right sidefield portion of the sighted region is displayed horizontally compressed in the right portion of the display screen. The center portion of the sighted region is displayed in the center portion of the display screen without horizontal compression.

The scope also includes a "rounds tracker" for tracking the amount of ammunition expended over a period of time or tracking the amount of ammunition which remains in the magazine of the gun. The rounds tracker includes a means for detecting when the gun has been fired and a "rounds count" display that is pictured on the display screen of the scope. In the preferred embodiment, the scope also includes a bank of user-selectable reticles.

An improved holster is also provided for use with the digital scope. The improved holster has a pocket that is configured to receive the scope and the gun when the scope and the gun are inserted into the pocket. Provided along with the holster is a means for activating the display screen automatically when the scope and the gun are removed from the pocket of the holster. In the preferred embodiment, a magnet is integrated with the holster, and a magnetically-reactive element is integrated with the scope. The magnetically-reactive element deactivates the scope when the scope is placed next to the magnet.

REFERENCE NUMERALS IN THE DRAWINGS

| | |
|---|---|
| 10 pistol | 12 action |
| 14 digital scope | 16 display screen |
| 18 zoom-in button | 20 zoom-out button |
| 22 auxilliary buttons | 24 zoomed region |
| 26 occluded region | 28 scan region |
| 30 zoomed foreground | 32 horizontally compressed sidefield |
| 34 horizontally compressed sidefield | 36 reticle |
| 38 rounds count display | 40 foreground |
| 42 left sidefield | 44 right sidefield |
| 46 horizon | 48 array of pixels |
| 50 selected pixel columns | 52 compressed left sidefield |
| 54 compressed right sidefield | 56 holster |
| 58 visor | 60 embedded deactivator |

DETAILED DESCRIPTION OF THE INVENTION

Figure 1:
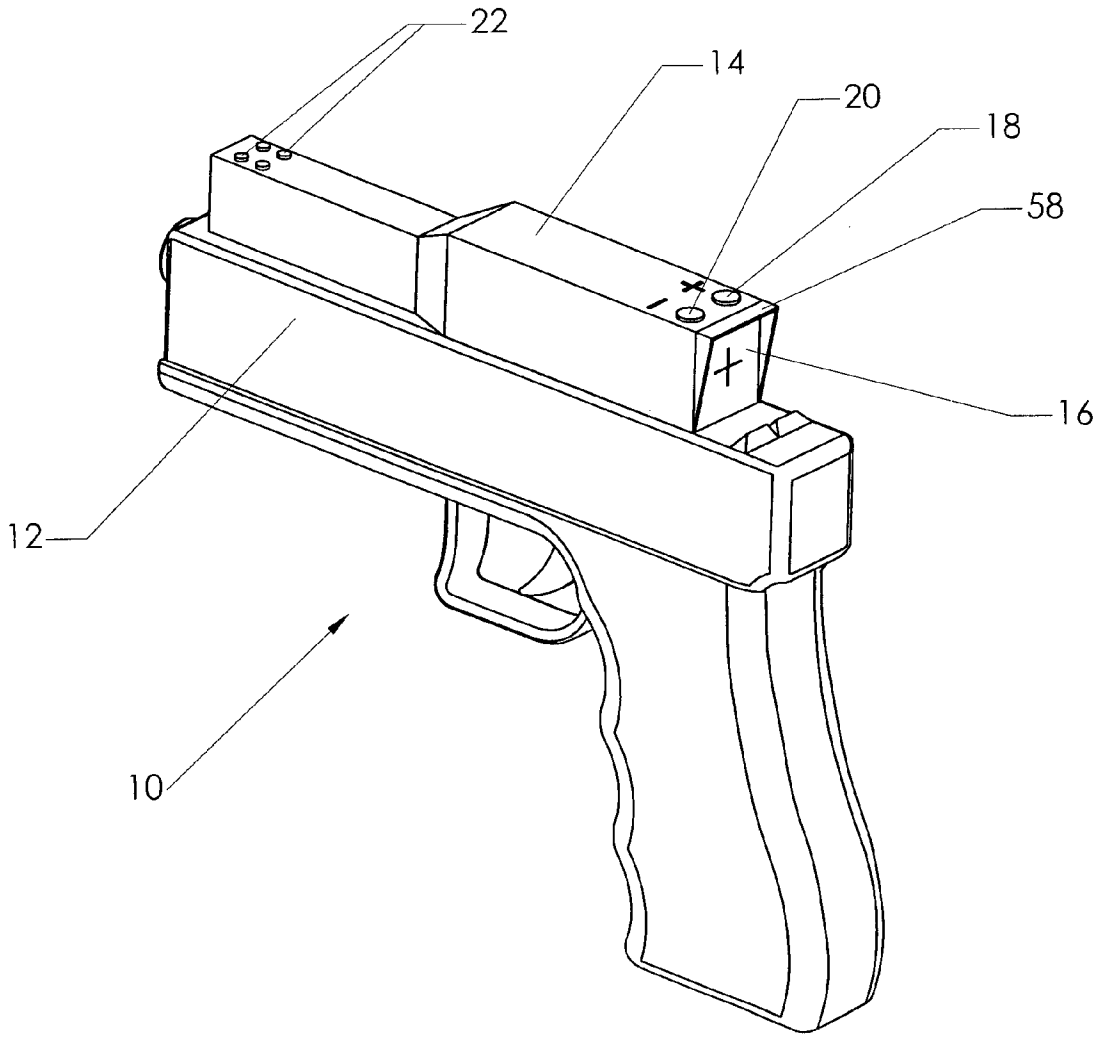
FIG. 1 is a perspective view, showing the present invention attached to a pistol.

The present invention, digital scope 14, is illustrated in FIG. 1. Digital scope 14 is mounted to action 12 of pistol 10. Any attachment means may be used to attach digital scope 14 to pistol 10, including the popular Weaver-style scope mount. Although digital scope 14 is shown attached to a semi-automatic type pistol, digital scope 14 may be used on other types of pistols and guns as well.

An image detection means is provided on the end of digital scope 14 which is facing away from the viewer in FIG. 1. The image detection means is configured to collect image data of a sighted region. When digital scope 14 is attached to the top of pistol 10, the image detection means collects image data from the region where the pistol 10 is aimed. The image detection means may include any sort of technology which is suitable for collecting image data. In the preferred embodiment, the image detection means includes a lens and an image sensing device. Various image sensors or imagers may be used including charge-coupled devices ("CCD"), Active Pixel Sensors ("APS"), complementary metal-oxide-semiconductor ("CMOS") sensor integrated circuits, vidicon tubes, or any other photosensitive devices.

Display screen 16 is electronically connected to the image detection means and is configured to display image data of the sighted region as a continuous video feed. Accordingly, the image detection means and display screen 16 together operate similarly to a camcorder or digital camera having a liquid crystal display ("LCD") feature. In the preferred embodiment, display screen 16 is an LCD screen. However, other display technologies may also be used. Visor 58 is provided on the sides and top of display screen 16 to reduce glare.

Digital scope 14 has zoom-in button 18 which increase the magnification of the region being sighted. Zoom-out button 20 is provided to decrease the magnification of the region being sighted. Although many different levels of magnification may be offered, the preferred embodiment includes magnification options of two times, four times, and eight times the normally-observed image resolution. Auxiliary buttons 22 are provided to access the enhanced features of digital scope 14. For example, one of the auxiliary buttons may display a "menu" on display screen 16. Once the "menu" is pulled up, other buttons (including zoom-out button 20 and zoom-in button 18) may be used to select, deselect, or adjust features of digital scope 14 that will be described in greater detail subsequently.

Figure 2:
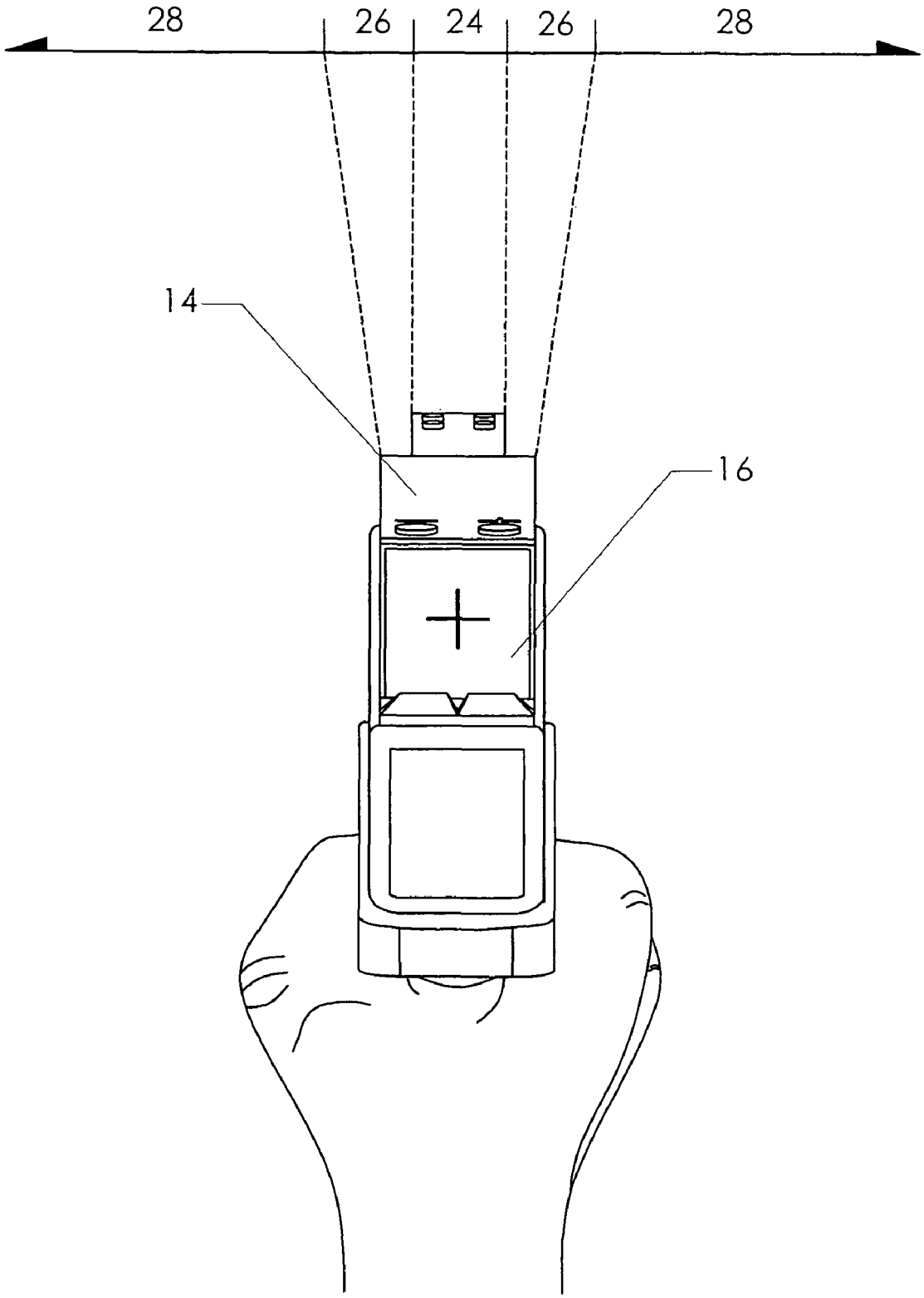
FIG. 2 is a perspective view, showing the present invention.

FIG. 2 is a perspective view of the present invention in use, shown from slightly above the viewpoint of the shooter. In FIG. 2, digital scope 14 is pointed at zoomed region 24. Accordingly, objects in zoomed region 24 would be displayed on display screen 16. When the refracted sidefields feature of the present invention is deselected, occluded regions 26 on both sides of zoomed region 24 are not visible to the user. Occluded regions 26 are regions "blocked" from the shooter's view by display screen 16 when the scope is placed in front of the shooter that do not fall within zoomed region 24. Outside of occluded regions 26 are scan regions 28. When the shooter focuses on display screen 16, the shooter can see objects in scan region 28 with the shooter's peripheral vision. The size of occluded regions 26 are both a function of the size of display screen 16, and the size of zoomed region. As the user increases the magnification power of digital scope 14, occluded regions 26 grow larger. Because the shooter cannot immediately see within the regions around zoomed region 24, it may be difficult for the shooter to spot other targets that may be hidden in occluded regions 26 or potential "friendly" targets which may inadvertently cross into the line of fire.

Figure 3:
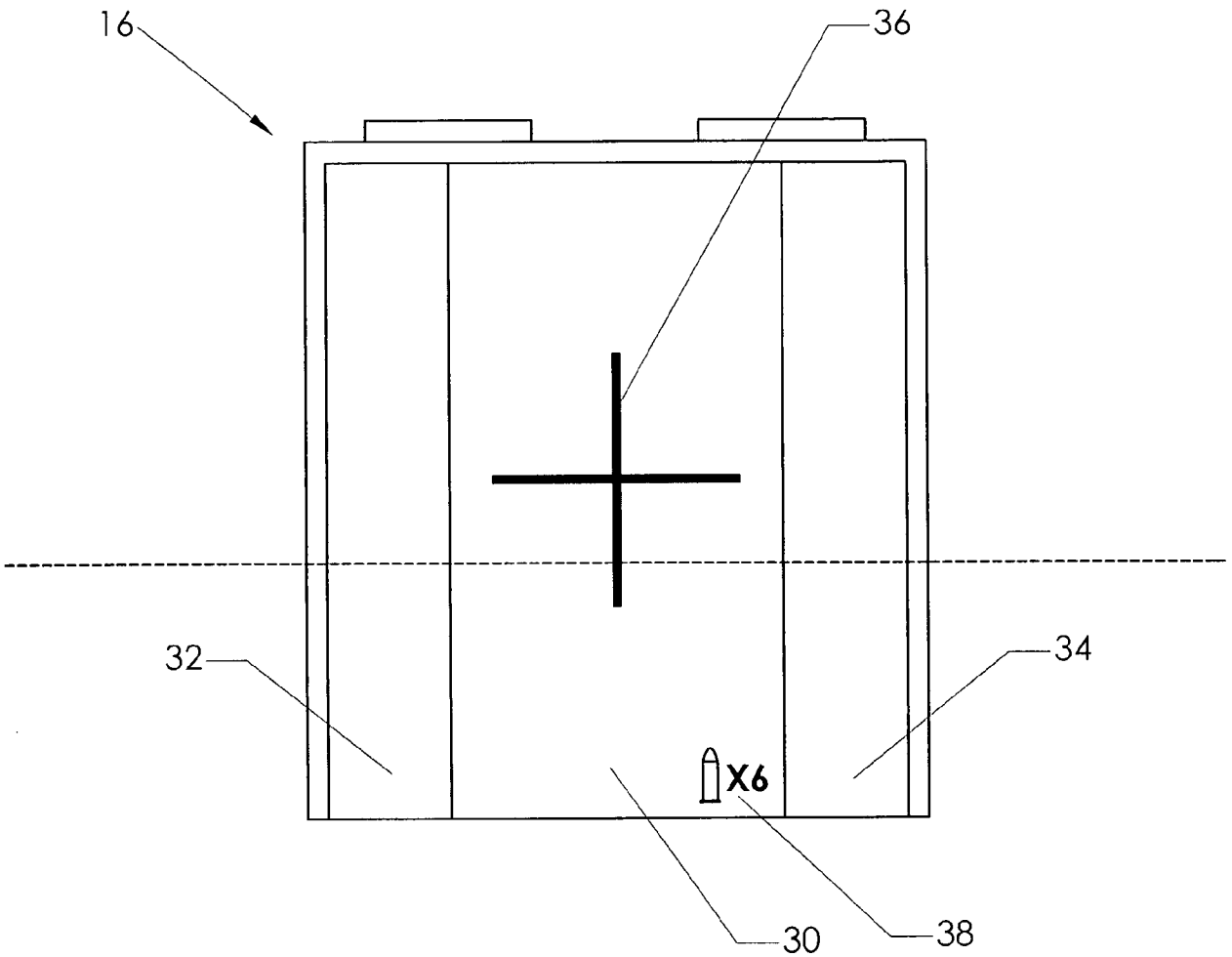
FIG. 3 is an illustration of a display screen.

In order to avoid the problems associated with occluded regions 26, the present invention uses horizontally compressed sidefields to allow the user to see objects that would normally fall within occluded regions 26. An example of a display screen 16 employing horizontally compressed sidefields 32 and 34 is illustrated in FIG. 3. The left sidefield portion of the sighted region is displayed in a horizontally compressed state in the left portion of display screen 16 as horizontally compressed sidefield 32. The right sidefield portion of the sighted region is displayed in a horizontally compressed state in the right portion of display screen 16 as horizontally compressed sidefield 34. The center portion of the sighted region, zoomed foreground 30, is displayed in the center portion of display screen 16 without horizontal compression.

Reticle 36 is provided as a display feature on display screen 16. Reticle 36 provides a reference point for the shooter when targeting an object. In the preferred embodiment, a bank of different reticles are provided so that the user may select a preferred reticle from the group. The user may access the bank of reticles by pressing auxiliary button 22 corresponding to "menu," and then selecting "change reticle" from the menu. Using auxiliary buttons 22, zoom-in button 18 or zoom-out button 20, the user may cycle through the different reticle options and select the reticle type that is preferred. Although many different types of reticles can be provided in the reticle bank, the preferred embodiment includes conventional reticles such as crosshairs, dots, hollow crosshairs, concentric circles, and dot within a circle. A reverse video option is also provided. This feature inverts the color of reticle pixels so that they are displayed at a high contrast with respect to the surrounding pixels. For example, if the reticle is conventionally displayed as black crosshairs, portions of the reticle that cover a black target will appear white. Software or firmware may be provided to store the bank of reticle options and to overlap the reticle display over the video feed from the image detection means.

The scope also includes a rounds tracker for tracking the number of rounds which are expended over a period of time or tracking the number of rounds remaining in the gun's magazine. The rounds tracker include a means for detecting when the gun has been fired and a rounds count display that is pictured on display screen 16. An example rounds count display 38 is illustrated in FIG. 3. Rounds count display 38 indicates how many rounds of ammunition remain in the magazine of the gun (6 rounds remain in the gun in the current illustration). Various means may be provided for detecting when the gun has been fired. One example includes integrating a noise gate with the scope that detects when a sound exceeds a design threshold. The noise gate sends a signal to a logic circuit indicating that it has detected a shot fired by the gun, and a counter tracks the number of shots fired. The user may "program" the scope to "know" how many rounds the user has started with, so the logic circuit simply subtracts "one" from the starting number each time the noise gate detects a shot fired. As with the reticle display, software of firmware is provided to overlay rounds count display 38 over the video feed. In addition, shock or vibration sensors for detecting recoil may be employed instead of or in addition to the noise gate.

Figure 4A:
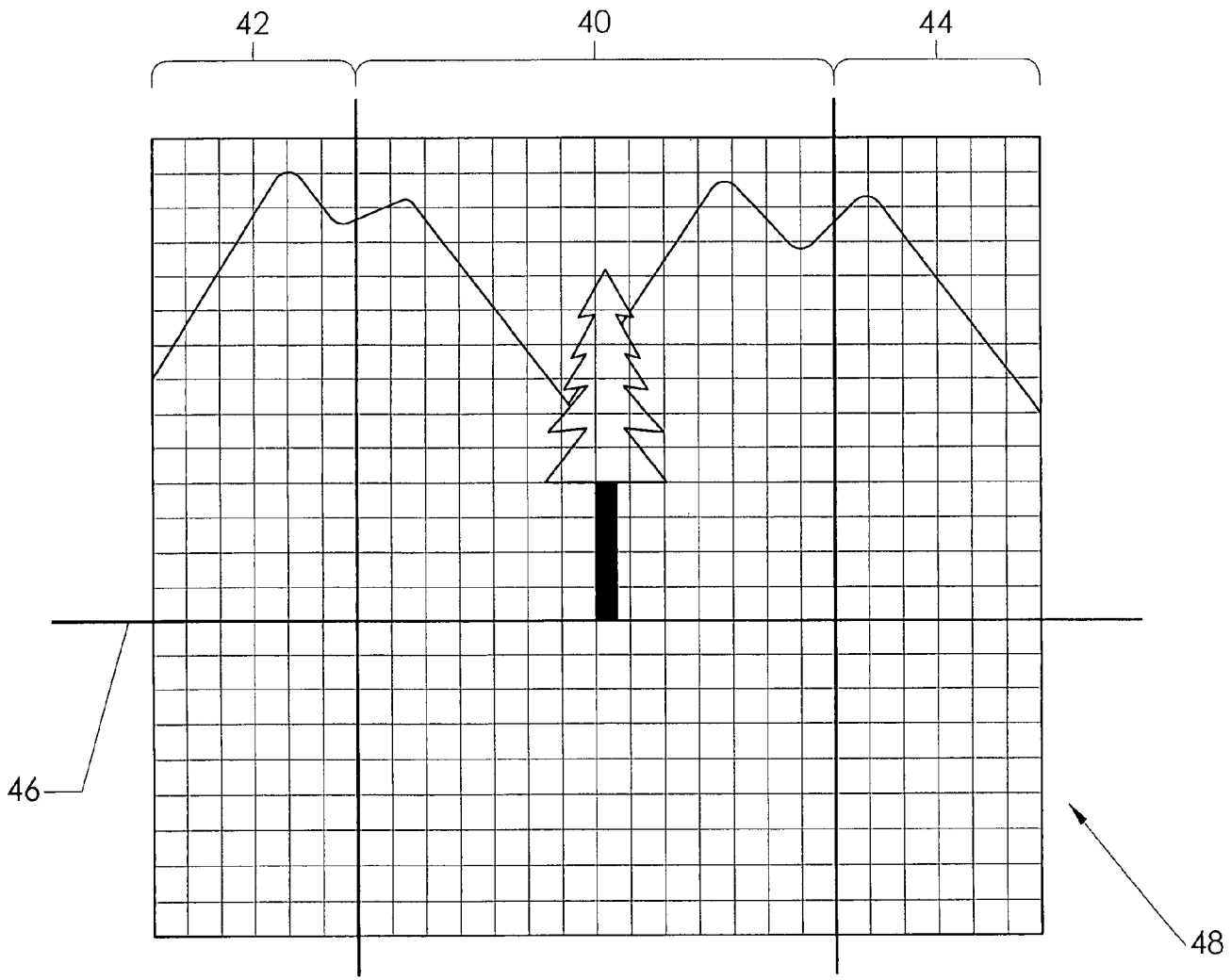
FIG. 4A is a pixel grid, illustrating the preferred embodiment of the present invention.
Figure 4B:
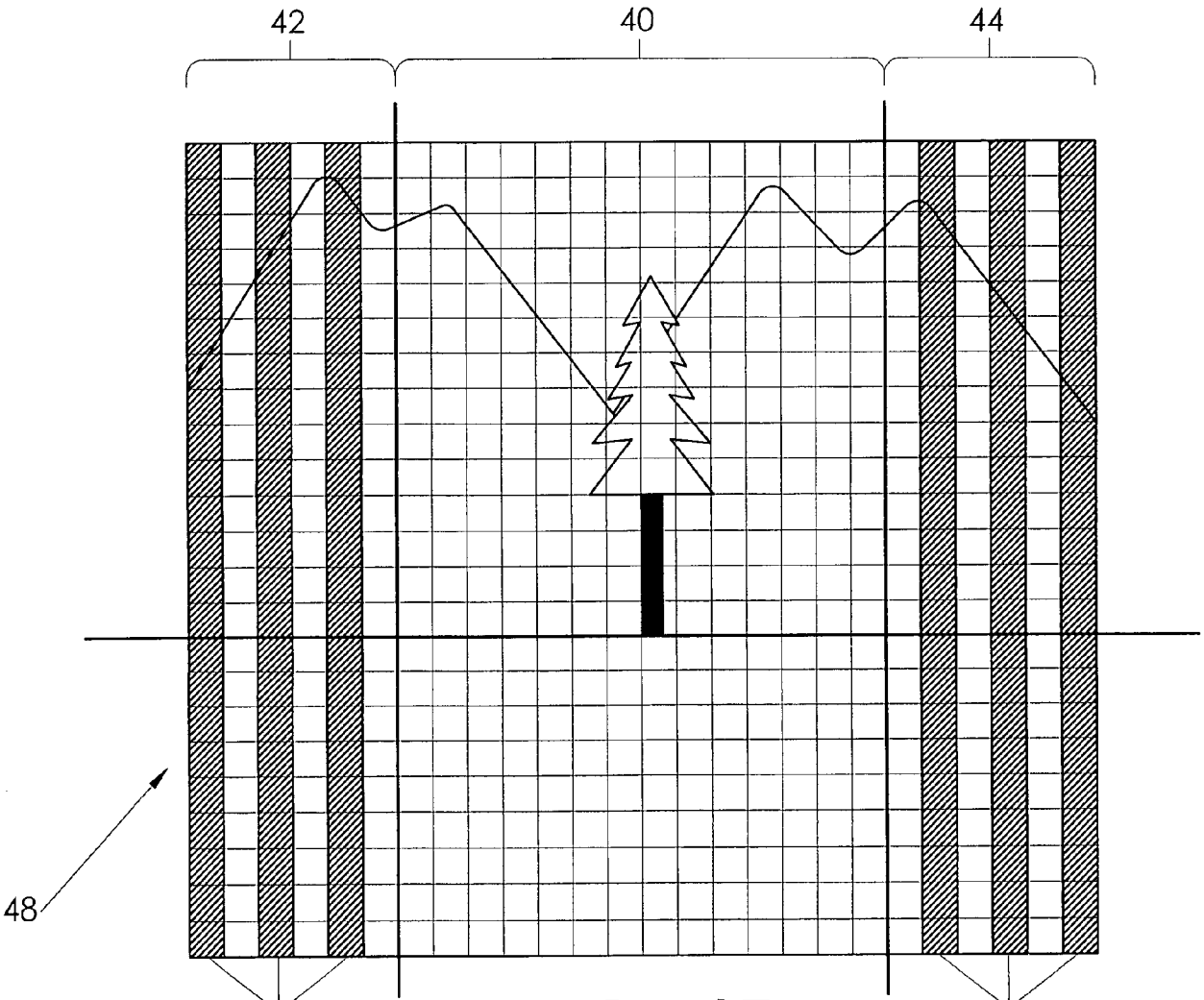
FIG. 4B is a pixel grid, illustrating the preferred embodiment of the present invention.
Figure 4C:
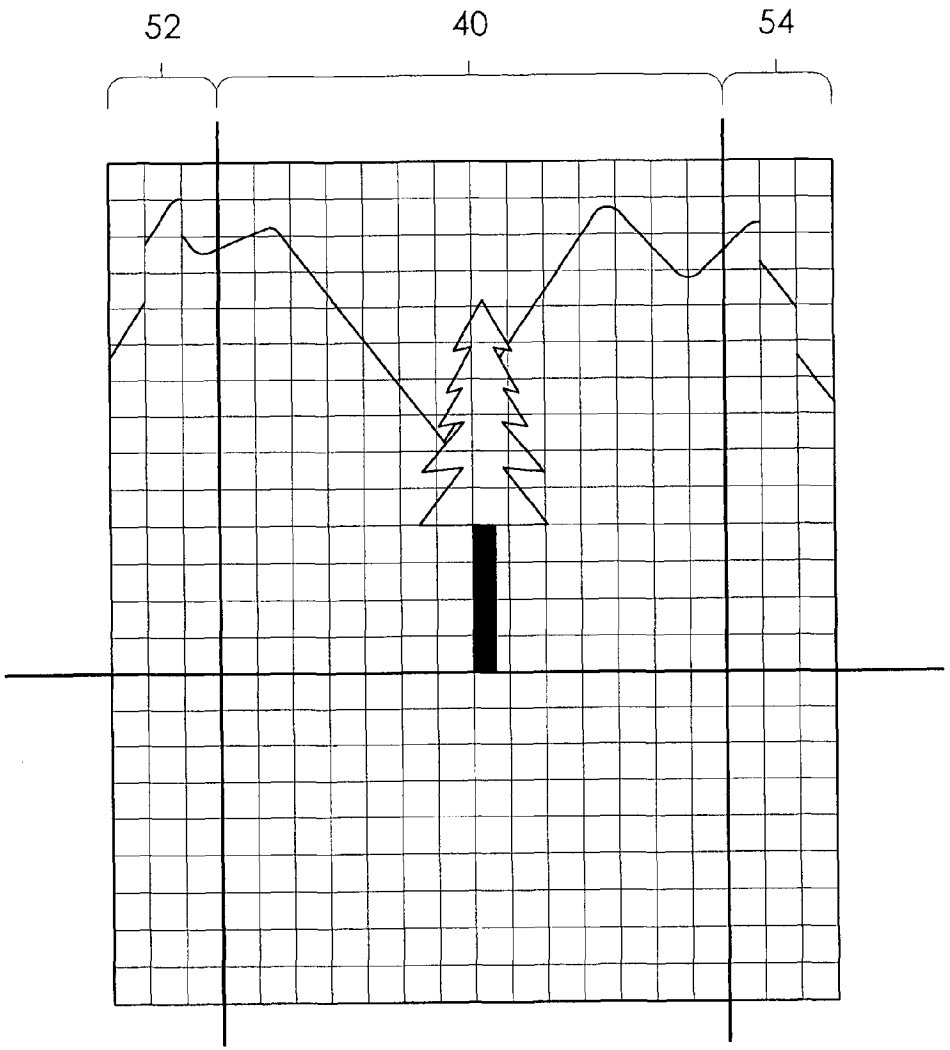
FIG. 4C is a pixel grid, illustrating the preferred embodiment of the present invention.

Although there are many ways to produce an image with horizontally compressed sidefields, the preferred process is illustrated in FIGS. 4A, 4B, and 4C. As shown in FIG. 4A, image data collected by the image detection means is rasterized as array of pixels 48 on a grid. Array of pixels 48 is composed of many different columns and rows of individual pixels. The reader will note that the each "pixel" illustrated in FIG. 4A actually represents a group of smaller pixels. The larger granularity employed in FIG. 4A is used for illustration purposes only. It shows an array comprised of 26 columns by 23 rows. Those that are skilled in the art will know that a much finer resolution is commonly available. The left sidefield portion of the sighted region is presented as an array of pixels on the grid denoted as left sidefield 42. The right sidefield portion of the sighted region is presented as an array of pixels on the grid denoted as right sidefield 44. The center portion of the sighted region is presented as an array of pixels on the grid denoted as foreground 40. Horizon 46 illustrates the ground line at the horizon perceived from the viewer's perspective.

Vertical columns within left sidefield 42 and right sidefield 44 are separated into two portions as shown in FIG. 4B. Selected pixel columns 50, indicated by columns with gray shading, are separated from the other non-selected columns, which appear without shading. In the current example, selected pixel columns 50 alternate in a one-for-one pattern with the unselected columns. The pattern need not be one-for-one. For example, there also could be two selected pixel columns 50 between every non-selected column.

The same image shown in FIGS. 4A and 4B is shown with horizontally compressed sidefields in FIG. 4C. The reader will note that selected pixel columns 50 have been removed from left sidefield 42 and right sidefield 44 to only display the non-selected columns. The resulting display appears as compressed left sidefield 52 and compressed right sidefield 54 with an uncompressed foreground 40.

Those that are skilled in the art will know that the scope can be calibrated so that everything within occluded regions 26 as shown in FIG. 2 is at least partially displayed within display screen 16. This limited image in the sidefields allows the shooter to perceive threats. If a threat is observed in a sidefield, the shooter can pan the gun over to the threat and view the threat with the desired amount of magnification.

When the user adjusts the level of magnification, software or firmware may be used to change the number of horizontally columns which are "dropped" from the display. For example, as the user zooms in, the objects in foreground 40 will appear larger causing a larger portion of the picture to be shifted to the sidefields. Instead of expanding the size of the sidefields, fewer column samples are displayed.

Figure 5:
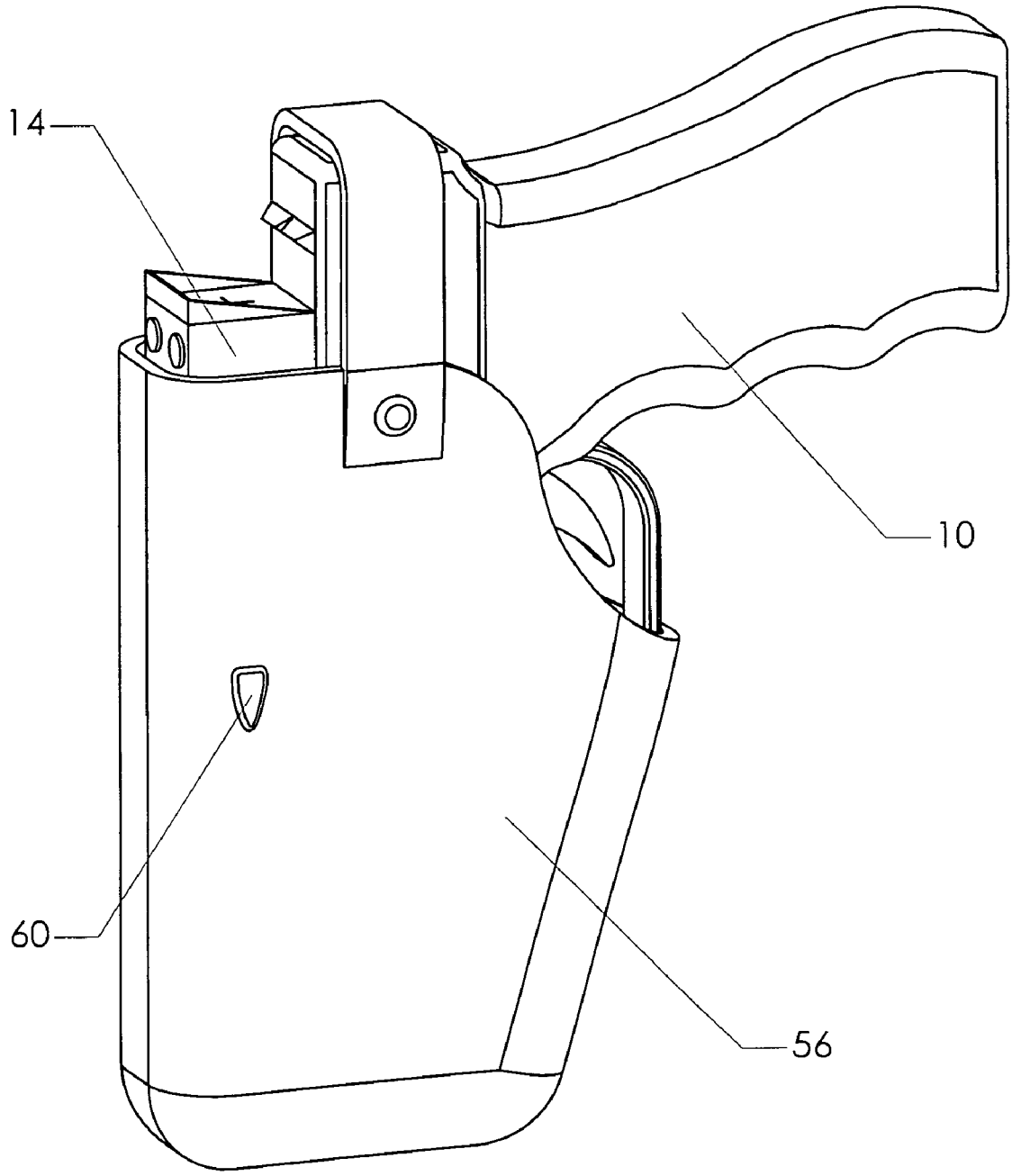
FIG. 5 is a perspective view, illustrating the present invention placed in a holster.

An improved holster is also provided for use with the digital scope, as illustrated in FIG. 5. Holster 56 has a pocket that is configured to receive digital scope 14 and pistol 10 when the digital scope 14 and pistol 10 are together inserted into the pocket. Provided along with the holster is a means for activating the display screen automatically when the scope and the gun are removed from the pocket of the holster. There are many ways to accomplish automatic activation. One way involves the inclusion of embedded deactivator 60 in holster 56. In the preferred embodiment, embedded deactivator 60 is a magnet. A magnetically-reactive element is included within digital scope 14. The magnetically-reactive element is configured to sense when the element is near embedded deactivator 60. When the element senses the presence of embedded deactivator 60, the magnetically-reactive element deactivates digital scope 14. Whenever the element no longer senses the presence of embedded deactivator 60, such as when pistol 10 is drawn out of holster 56, the magnetically reactive element activates digital scope 14. Accordingly, using embedded deactivator 60, the shooter need not do anything to activate digital scope 14 beyond drawing pistol 10 out of holster 56. When the user replaces the pistol, it switches back off.

The preceding description contains significant detail regarding the novel aspects of the present invention. It should not be construed, however, as limiting the scope of the invention but rather as providing illustrations of the preferred embodiments of the invention. As an example, embedded deactivator 60 may be any feature that is configured to deactivate digital scope 14 when digital scope 14 is placed into holster 56 and activate digital scope 14 when digital scope 14 is removed from holster 56. Embedded deactivator 60 may be a protrusion or tab that mates with a corresponding receiver on digital scope 14 when pistol 10 is holstered. The physical interaction between the protrusion or tab on embedded deactivator 60 and the receiver on digital scope 14 may engage a switch that deactivates the scope. Such variations would not alter the function of the invention. Thus, the scope of the invention should be fixed by the following claims, rather than by the examples given.

Having described my invention, I claim:

1. A scope for locating and targeting a target object to be shot with a gun, said scope having a first end and a second end, comprising:

a. an image detection means, proximal said first end of said scope, said image detection means configured to collect image data of a sighted region, said sighted region having a left sidefield portion, a right sidefield portion, and a center portion therebetween;

b. a display screen, proximal said second end of said scope, said display screen electronically connected to said image detection means and configured to display said image data of said sighted region as a continuous video feed, said display screen having a left portion, a right portion, and a center portion therebetween; and c. wherein said left sidefield portion of said sighted region is displayed horizontally compressed in said left portion of said display screen, said right sidefield portion of said sighted region is displayed horizontally compressed in said right portion of said display screen, and said center portion of said sighted region is displayed in said center portion of said display screen.

2. The scope of claim 1, further comprising a rounds tracker, said rounds tracker including:

a. a means for detecting when said gun has been fired; and b. a rounds count display pictured on said display screen, said rounds count display configured to display information regarding the quantity of ammunition rounds remaining in said gun.

3. The scope of claim 2, wherein said left and right sidefield portions of said sighted region is displayed horizontally compressed by:

a. rasterizing each of said left and right sidefield portion of said sighted region as an array of pixels on a grid, said array of pixels arranged as a plurality of horizontal rows and a plurality of vertical columns;

b. separating said plurality of vertical columns into a first portion and a second portion; and c. displaying said first portion without said second portion.

4. The scope of claim 2, further comprising:

a. a holster, having a pocket configured to receive said scope and said gun when said scope and said gun are together inserted into said pocket; and b. a means for activating said display screen automatically when said scope and said gun are removed from said pocket of said holster.

5. The scope of claim 1, wherein said scope further includes:

a. a plurality of reticles stored in a reticle bank, each of said plurality of reticles displayable upon said display screen, and b. a means for cycling through said plurality of reticles and selecting one of said plurality of reticles to display on said display screen.

6. The scope of claim 1, wherein said left and right sidefield portions of said sighted region are displayed horizontally compressed by:

a. rasterizing each of said left and right sidefield portions of said sighted region as an array of pixels on a grid, said array of pixels arranged as a plurality of horizontal rows and a plurality of vertical columns;

b. separating said plurality of vertical columns into a first portion and a second portion; and c. displaying said first portion without said second portion.

7. The scope of claim 6, further comprising:

a. a holster, having a pocket configured to receive said scope and said gun when said scope and said gun are together inserted into said pocket; and b. a means for activating said display screen automatically when said scope and said gun are removed from said pocket of said holster.

8. The scope of claim 1, further comprising:

a. a holster, having a pocket configured to receive said scope and said gun when said scope and said gun are together inserted into said pocket; and b. a means for activating said display screen automatically when said scope and said gun are removed from said pocket of said holster.

9. The scope of claim 8, wherein said means for activating said display screen includes a magnet, said magnet attached to said holster.

10. A scope for locating and targeting a target object to be shot with a gun, said scope having a first end and a second end, comprising:

a. an image detection means, proximal said first end of said scope, said image detection means configured to collect image data of a sighted region, said sighted region having a left sidefield portion, a right sidefield portion, and a center portion therebetween;

b. a display screen, proximal said second end of said scope, said display screen electronically connected to said image detection means and configured to display said image data of said sighted region as a continuous video feed, said display screen having a left portion, a right portion, and a center portion therebetween;

c. an attachment means for attaching said scope to said gun;

d. a holster, having a pocket configured to receive said scope and said gun when said scope and said gun are together inserted into said pocket; and e. a means for activating said display screen automatically when said scope and said gun are removed from said pocket of said holster.

11. The scope of claim 10, wherein said means for activating said display screen includes a magnet, said magnet attached to said holster.

12. The scope of claim 11, wherein said means for activating said display screen includes a magnetically-reactive element, said magnetically-reactive element integrated with said scope and configured to deactivate said scope when said scope is placed next to said magnet.

13. The scope of claim 10, wherein said left sidefield portion of said sighted region is displayed horizontally compressed in said left portion of said display screen, said right sidefield portion of said sighted region is displayed horizontally compressed in said right portion of said display screen, and said center portion of said sighted region is displayed in said center portion of said display screen.

14. The scope of claim 13, wherein said left sidefield portion of said sighted region is displayed horizontally compressed by:

a. rasterizing said left sidefield portion of said sighted region as an array of pixels on a grid, said array of pixels arranged as a plurality of horizontal rows and a plurality of vertical columns;

b. separating said plurality of vertical columns into a first portion and a second portion; and c. displaying said first portion without said second portion.

15. The scope of claim 10, further comprising a rounds tracker, said rounds tracker including:

a. a means for detecting when said gun has been fired; and b. a rounds count display pictured on said display screen, said rounds count display configured to display information regarding the quantity of ammunition rounds remaining in said gun.

16. The scope of claim 10, wherein said scope further includes:

a. a plurality of reticles stored in a reticle bank, each of said plurality of reticles displayable upon said display means, and b. a means for cycling through said plurality of reticles and selecting one of said plurality of reticles to display on said display screen.

* * * * *